United States Patent [19]

Mignot

[11] 4,334,012

[45] Jun. 8, 1982

[54] SILVER HALIDE PRECIPITATION PROCESS WITH DELETION OF MATERIALS

[75] Inventor: Andre G. E. Mignot, Bonneuil-sur-Marne, France

[73] Assignee: Eastman Kodak Company, Rochester, N.Y.

[21] Appl. No.: 280,625

[22] Filed: Jul. 6, 1981

Related U.S. Application Data

[63] Continuation-in-part of Ser. No. 215,890, Dec. 12, 1980, abandoned, which is a continuation-in-part of Ser. No. 116,685, Jan. 30, 1980, abandoned.

[51] Int. Cl.[3] ..... G03C 1/02

[52] U.S. Cl. ..... 430/567; 430/569

[58] Field of Search ..... 430/567, 569

[56] References Cited

U.S. PATENT DOCUMENTS

| | | |
|---|---|---|
| 3,326,641 | 6/1967 | Audran et al. . |
| 3,790,386 | 2/1974 | Posse et al. . |
| 3,801,326 | 4/1974 | Claes . |
| 3,897,935 | 8/1975 | Forster et al. . |
| 4,046,576 | 9/1977 | Terwilliger et al. . |
| 4,147,551 | 4/1979 | Finnicum et al. . |
| 4,171,224 | 10/1979 | Verhille et al. . |

FOREIGN PATENT DOCUMENTS

| | | |
|---|---|---|
| 2239699 | 7/1974 | France . |
| 1302405 | 1/1973 | United Kingdom . |

OTHER PUBLICATIONS

Research Disclosure, vol. 102, Oct. 1972, Item 10208.
Research Disclosure, vol. 131, Mar. 1975, Item 13122.

*Primary Examiner*—Won H. Louie, Jr.
*Attorney, Agent, or Firm*—Carl O. Thomas

[57] ABSTRACT

An improved silver halide precipitation process of preparing a dispersion of silver halide grains is disclosed. The process comprises forming a radiation-sensitive silver halide dispersion by reacting silver and halide salts in solution within a dispersing medium to form silver halide grain nuclei within the dispersing medium and allowing silver halide grain growth to occur in a reaction vessel in which the silver halide grain nuclei and the dispersing medium are present. The improvement comprises, while increasing silver halide present in the dispersing medium during silver halide grain growth, reducing the volume of the dispersion by separating a portion of the dispersing medium while retaining the silver halide grains within the remaining dispersion.

27 Claims, 1 Drawing Figure

SILVER HALIDE PRECIPITATION PROCESS WITH DELETION OF MATERIALS

This is a continuation-in-part of U.S. Ser. No. 215,890, filed Dec. 12, 1980, now abandoned, which is a continuation-in-part of U.S. Ser. No. 116,685, filed Jan. 30, 1980, now abandoned.

FIELD OF THE INVENTION

The present invention is drawn to an improvement in processes of preparing dispersions of radiation-sensitive silver halide grains.

DESCRIPTION OF THE STATE OF THE ART

Radiation-sensitive silver halide grains can be prepared by a variety of conventional techniques. One common approach is a batch preparation technique commonly referred to as a single-jet (or single-run) precipitation technique. According to this technique a silver salt solution is run into a reaction vessel containing a halide salt solution. The first silver salt introduced into the reaction vessel reacts with halide salt to form silver halide grain nuclei. Thereafter, as additional silver salt is introduced, additional silver halide is formed as a reaction product. Some of this silver halide forms additional nuclei while the remaining silver halide is concurrently deposited on the existing silver halide grain nuclei. Single-jet precipitation is discussed by T. H. James, *The Theory of the Photographic Process,* 4th Ed., Macmillan, 1977, Chapter 3, and is specifically illustrated by Trivelli and Smith *The Photographic Journal,* Vol. LXXIX, May 1939, pp. 300–338.

Another approach to silver halide preparation is a batch approach commonly referred to as a double-jet (or double-run) precipitation technique. According to this approach a silver salt solution and a halide salt solution are concurrently run into a reaction vessel containing a dispersing medium. Precipitation of silver halide grains preferably occurs in two distinct stages. In a first, nucleation stage, initial silver halide grain formation occurs. This is followed by a second, growth stage in which additional silver halide formed as a reaction product precipitates onto the initially formed silver halide grains, resulting in growth of these silver halide grains. Batch double-jet precipitations are typically undertaken under conditions of rapid stirring of reactants in which the volume within the reaction vessel continuously increases during the silver halide precipitation make or run.

DISCUSSION OF SPECIFIC PRIOR ART

Continuous double-jet precipitation procedures are known, as illustrated by U.K. Pat. No. 1,302,405, Claes U.S. Pat. No. 3,801,326, and Terwilliger et al U.S. Pat. No. 4,046,576, in which the volume of the reaction vessel remains constant during silver halide precipitation under steady-state operating conditions by reason of continuous removal of silver halide dispersion.

Posse et al U.S. Pat. No. 3,790,386 is directed to a variant form of a continuous double-jet precipitation technique in which the silver halide dispersion is continuously withdrawn from a constant volume reaction vessel and fed to a separate ripening vessel which is at least 10 times the volume of the reaction vessel. Posse et al makes no provision for the removal of soluble salts or dispersing medium from the silver halide dispersions produced; hence the total volume of the dispersion in the reaction and ripening vessels increases in direct relation to the salt solutions added. Similar continuous double-jet precipitation arrangements are disclosed by Forster et al U.S. Pat. No. 3,897,935, Finnicum et al U.S. Pat. No. 4,147,551, and Verhille et al U.S. Pat. No. 4,171,224.

The purification and/or concentration of silver halide emulsions by ultrafiltration (also termed diafiltration) is known in the art. Such techniques are illustrated by *Research Disclosure,* Vol. 102, October 1972, Item 10208, and Vol. 131, March 1975, Item 13122. *Research Disclosure* is published by Industrial Opportunities Ltd., Homewell, Havant Hampshire, P09 1EF, U.K. It is recognized that the soluble salts, such as alkali nitrate, formed as a by-product in precipitating silver halide can be removed by ultrafiltration while continuously adding makeup water to the emulsion. After the soluble salt content has been reduced to the desired level, it is taught to terminate the addition of makeup water and to reduce the liquid volume of the emulsion by ultrafiltration. The liquid volume of the emulsion can also be reduced by ultrafiltration after addenda have been added and before coating.

ADVANTAGES OF THE INVENTION—IN GENERAL

The present invention is directed to an improved process for the preparation of radiation-sensitive silver halide dispersions. As compared with conventional precipitation processes, the present process can be employed to (1) avoid any tendency toward continued formation of silver halide grains during the growth stage of silver halide precipitation (i.e., renucleation), (2) reduce unwanted crystal imperfections of silver halide grains, (3) reduce reduction fogging of silver halide grains, and (4) produce silver halide grains of less variability in sensitivity. As compared to conventional batch precipitation processes, less variation in the volume of materials in the reaction vessel occurs. This permits a better match between the reaction vessel capacity and the materials volume. For example, more uniform stirring as a function of both run time and reaction vessel volume can be achieved for a given reaction vessel. Higher stirring rates can be employed. Foaming due to air entrapment within the reaction vessel on startup can be obviated. More dilute solutions can be employed without dilution of the silver halide dispersion produced as a final product. It is preferred to prepare silver halide dispersions according to this process with reduced variation in or, most preferably, constant volumes in the reaction vessels. It is possible to produce by the present process a quantity of silver halide grains that, by conventional procedures, require up to 8 times more reaction vessel capacity. This permits output to be increased with existing reaction vessel capacity or the size and/or number of the reaction vessels to be reduced while retaining existing output levels.

ADVANTAGES OF THE INVENTION—COLLOID-FREE DISPERSIONS

The foregoing discussion of the present process is equally applicable to silver halide dispersions prepared in the presence or absence of peptizers. This invention offers further distinct advantages as applied to the precipitation of silver halide grains in the absence of a peptizer. Peptizers, such as hydrophilic colloids, are commonly employed in the preparation of silver halide dispersions to prevent coalescence or flocculation of the silver halide grains. Although advantageous for this purpose, the presence of hydrophilic colloids is known to place limitations on silver halide grains, such as influencing crystal habit, grain distribution, and the character and distribution of crystal defects (see *The Theory of the Photographic Process,* Macmillan, 2nd ed., pp. 85 and 85 and 4th ed., pp. 29–31). The presence of hydrophilic colloids can also interfere with the incorporation of dopants in the silver halide grains. Techniques are known for preparing silver halide grains in the absence of hydrophilic colloids. French Pat. No. 1,173,517, for example, describes a process for preparing silver halide dispersions in the absence of a hydrophilic colloid; but, to prevent silver halide grain flocculation, it is necessary (a) to use highly dilute aqueous salt solutions, (b) to use a surface active agent when the salt solutions are more concentrated, or (c) to prepare highly ammoniacal silver halide dispersions using more concentrated salt solutions. The invention provides a process which reduces limitations heretofore encountered in silver halide precipitation in the absence of hydrophilic colloids. For example, silver halide grains of larger size can be produced in the absence of a hydrophilic colloid peptizer and without resort to surfactants and/or ammoniacal solutions.

SUMMARY OF THE INVENTION

In one aspect, the present invention is directed to an improved process comprising forming a radiation-sensitive silver halide dispersion by reacting silver and halide salts in solution, wherein the silver and halide salts are reacted to form silver halide grain nuclei in the presence of a dispersing medium and silver halide grain growth is allowed to proceed in a reaction vessel in which the silver halide grain nuclei and the dispersing medium are present. The improvemet comprises, while increasing silver halide present in the dispersing medium during silver halide grain growth, reducing the volume of the dispersion by separating a portion of the dispersing medium while retaining the silver halide grains within the dispersion remaining.

BRIEF DESCRIPTION OF THE DRAWING

The FIGURE is a schematic flow diagram of a double-jet batch precipitation arrangement according to this invention.

DESCRIPTION OF PREFERRED EMBODIMENTS

Figure 1:
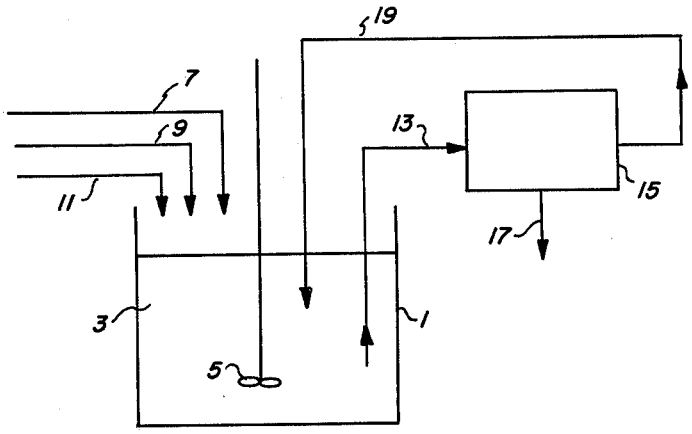

An improved batch double-jet precipitation process of the present invention can be illustrated by reference to the drawing, in which the reaction vessel 1 initially contains a dispersing medium 3. A mechanism 5 for stirring the dispersing medium is schematically illustrated as a propellor attached to a rotatable shaft, although the mechanism can be of any conventional form. With the stirring mechanism in operation, a silver salt solution is run into the reaction vessel through a first jet 7, and a halide salt solution is concurrently run into the reaction vessel through a second jet 9. In the diagram an optional, third jet 11 is shown, the use of which is described below.

The stirring mechanism causes the salt solutions to be substantially instantaneously mixed with the dispersing medium. The halide salt solution contains a soluble halide salt that reacts with a soluble silver salt contained in the silver salt solution to form silver halide as a reaction product. During the initial stage of silver halide formation, referred to as the nucleation stage, a substantially uniform dispersion of silver halide grains is formed. As addition of the silver and halide solutions continues, a transition occurs to a second, growth stage of precipitation in which additional silver halide formed as a reaction product is precipitated onto the initially formed silver halide grains, causing these grains to increase in size. In preparing monodispersed dispersions the formation of additional silver halide grains during the growth stage is minimal, but in forming polydispersed dispersions the formation of additional silver halide grains continues while growth of previously formed silver halide is occurring, resulting in a wide range of silver halide grain sizes.

The volume of materials within the reaction vessel can be controlled by removing a portion of the silver halide dispersion as indicated schematically by flow path 13, which leads to an ultrafiltration unit 15. The ultrafiltration unit reduces the volume of the silver halide dispersion received by separating a portion of the dispersing medium, as indicated schematically by flow path 17, while retaining the silver halide grains within the remaining silver halide dispersion, referred to as the retentate. The silver halide dispersion thus reduced in volume, or retentate, is returned to the reaction vessel, as indicated by flow path 19. The flow paths 13 and 19, the ultrafiltration unit 15 and any other features not specifically described, but clearly within the ordinary skill of the art to provide, such as one or more valves, pumps or meters, constitute and are hereinafter collectively referred to as an ultrafiltration loop. Ultrafiltration is particularly effective during the growth stage of precipitation, but the ultrafiltration loop can be activated during the nucleating stage or even before commencing introduction of the silver salt, if desired.

When the silver halide dispersion is a photographic emulsion, a peptizer, such as a hydrophilic colloid, is present in the reaction vessel. The peptizer can be in the dispersing medium within the reaction vessel prior to addition of salt solutions. Alternatively, the peptizer can be added through the third jet 11 or through one of the first and second jets, which supply the silver and halide salts, respectively, or the peptizer can be introduced into the reaction vessel using any combination of the above. The peptizer need not be present during the nucleation stage of precipitation, but, when employed, is preferably present during at least a portion of the time ultrafiltration is occurring. In preparing photographic silver halide emulsions a peptizer is typically present during both the nucleation and growth stages of nucleation. Advantageously, ultrafiltration does not remove any substantial proportion of the peptizer, but selectively removes the liquid component of the dispersing medium.

In removing the liquid component of the dispersing medium by ultrafiltration, soluble salts contained in the liquid component are concurrently removed. For example, a silver nitrate introduced in the silver salt solution reacts with an alkali or ammonium halide introduced in the halide salt solution to form silver halide as a substantially insoluble reaction product and alkali nitrate as a soluble reaction product. Ultrafiltration removes both liquid dispersing medium and the alkali or ammonium nitrate salt dissolved in the dispersing medium.

The removal of soluble salts by ultrafiltration is particularly important in preparing silver halide dispersions in the absence of a peptizer. It is known that the buildup of soluble salts is one factor which can initiate flocculation of the silver halide grains. Removal of soluble salts by ultrafiltration reduces the risk of silver halide flocculation occurring and permits larger silver halide grains to be formed in the absence of other protective measures to avoid flocculation.

In the preparation of a silver halide dispersion in the absence of a peptizer it is advantageous to reduce further the concentration of soluble salts within the reaction vessel by introducing additional dispersing medium into the reaction vessel. In this instance the additional dispersing medium and the ultrafiltration unit are working together to reduce the concentration of soluble salts within the reaction vessel. The contribution of the additional dispersing medium to the silver halide dispersion volume within the reaction vessel is at least partially offset by the ultrafiltration unit's removal of dispersing medium.

The additional dispersing medium can be introduced into the reaction vessel in any convenient manner. For example, it is contemplated to introduce additional dispersing medium through the third jet 11. In a preferred form the third jet is used to introduce a dilute halide salt solution, preferably a halide salt solution of 0.01 molar or less.

In the absence of a peptizer the concentration within the reaction vessel of the soluble salt formed as a reaction product is less than 0.1 mole per liter, preferably less than 0.05 mole per liter and optimally less than 0.01 mole per liter. In the presence of a peptizer the concentration of the soluble salts can be at any conventional level. For example, maximum soluble salt concentrations of up to 3 moles per liter are contemplated.

Ultrafiltration can be conducted at any stage of silver halide precipitation. Ultrafiltration is preferably conducted during at least a portion of the silver halide grain growth stage of precipitation and is most preferably conducted throughout the growth stage. Although it was originally thought that ultrafiltration should be delayed until after the nucleation of silver halide grain formation, further investigation has revealed that ultrafiltration can be commenced during the nucleation stage of silver halide precipitation or even on start up to commence flow through the ultrafiltration unit before silver halide precipitation is begun. This is possible for two reasons: (1) ultrafiltration membranes are available exhibiting penetration cutoff values in low molecular weight ranges, as discussed below, and (2) silver halide grain nuclei increase almost instantaneously to about 0.03 micron in size. Typically silver halide grain nuclei emerging from a rotating stirring device toward which silver and halide salts are directed are already at least 0.03 micron in size. Thus, an ultrafiltration membrane of a relatively low cutoff value (often capable of separating particles measured in Angstroms) can readily separate the silver halide nuclei from the soluble salts and the dispersing medium.

While other techniques are known capable of separating dispersing media and/or soluble salts from silver halide dispersions, particularly photographic silver halide emulsions, ultrafiltration during silver halide grain precipitation offers a number of unique advantages and avoids unsuitable limitations of alternative separation approaches. One distinct advantage of ultrafiltration is that the silver halide dispersion taken up by the ultrafiltration loop can be returned to the reaction vessel within a very short period of time. For example, the time to traverse the ultrafiltration loop is preferably less than B 10 percent, most preferably less than 1 percent, of the total run time. Another distinct advantage of ultrafiltration is that only a very small proportion of the silver halide dispersion need be absent from the reaction vessel at any one time. In all instances the amount of silver halide in the ultrafiltration loop is less than 50 percent (preferably less than 25 percent) of the volume of the silver halide in the reaction vessel.

Any conventional dispersing medium can be initially present in the reaction vessel. Typically the dispersing medium volume initially present in the reaction vessel is from about 10 to 90 percent, preferably 20 to 80 percent, that of the silver halide dispersion to be formed. The dispersing medium is preferably water or a dispersion of peptizer in water, optionally containing other ingredients, such as one or more silver halide ripening agents, more specifically described below. Where a peptizer is employed, it is preferably present in a concentration of at least 10 percent, most preferably 20 percent, of the total peptizer present at the completion of the make or run, the balance of the peptizer, if any, being added during addition of the silver and halide salts. A minor portion, typically less than about 10 percent, of one of the silver and halide salt solutions is also initially present in the reaction vessel to adjust the silver ion concentration of the dispersing medium at the outset of silver halide precipitation. Silver ion concentration is routinely measured and referred to by those skilled in the art in terms of pAg (log reciprocal silver ion concentration).

The separate silver and halide salt solutions and techniques for their concurrent introduction into the reaction vessel can take any conventional form known to be useful in double-jet silver halide precipitation processes. *Research Disclosure,* Vol. 176, December 1978, Item 17643, Paragraph I and the materials cited therein, such as Nietz et al U.S. Pat. No. 2,222,264, Illingsworth U.S. Pat. Nos. 3,320,069 and 3,655,394, Kurz U.S. Pat. No. 3,672,900, Evans U.S. Pat. No. 3,761,276, and Wilgus German OLS No. 2,107,118, illustrate conventional double-jet precipitation techniques useful in the practice of this invention. Specifically preferred double-jet precipitation techniques are those which achieve shortened silver halide precipitation times by employing accelerated rates of addition of silver and halide salt solutions without inducing nucleation in the growth stage. Such techniques are disclosed by Kurz and Wilgus, cited above, and here incorporated by reference.

Typically the silver salt solution is an aqueous solution of a soluble silver salt, such as silver nitrate, while the halide salt solution is an aqueous solution of one or more water soluble ammonium, alkali metal (e.g., sodium or potassium) or alkaline earth metal (e.g., magnesium or calcium) halide salts. Useful halides are chlorides, bromides and iodides. Ordinarily iodide accounts for less than 20 mole percent, preferably less than 6 mole percent, of the silver halide, based on total halide. When a plurality of halide salts are employed, they can be introduced separately or in a single jet. Preferably the soluble silver salt and the soluble halide salt are present in aqueous solutions in concentrations of from 0.1 to 2 moles per liter.

Sensitizing compounds can be present during silver halide precipitation. Such compounds can be initially in the reaction vessel or can be added along with one or more of the jets according to conventional procedures. Sensitizing compounds, such as compounds of copper, thallium, lead, bismuth, cadmium, zinc, middle chalcogens (i.e., sulfur, selenium and tellurium), and Group VIII noble metals, can be present during silver halide precipitation, as illustrated by Arnold et al. U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, and Atwell U.S. Ser. No. 27,325, filed Apr. 5, 1979.

The individual reactants can be added to the reaction vessel through surface or subsurface delivery tubes by gravity feed or by delivery apparatus for maintaining control of the rate of delivery and the pH and/or pAg of the reaction vessel contents, as illustrated by Culhane et al U.S. Pat. No. 3,821,002, Oliver U.S. Pat. No. 3,031,304 and Claes et al., *Photographische Korrespondenz,* 102 Band, Number 10, 1967, p. 162. In order to obtain rapid distribution of the reactants within the reaction vessel, specially contructed mixing devices can be employed, as illustrated by Audran U.S. Pat. No. 2,996,287, McCrossen et al U.S. Pat. No. 3,342,605, Frame et al U.S. Pat. No. 3,415,650, Porter et al. U.S. Pat. No. 3,785,777, Saito et al German OLS Nos. 2,555,364 and 2,556,885, and *Research Disclosure,* Volume 166, February 1978, Item 16662.

Although the reaction vessel 1 is diagrammatically illustrated as being open, it is specifically contemplated that the reaction vessel can be closed, except as required to permit ingress and egress through the indicated flow paths 7, 9, 11, 13, and 19. Thus the reaction vessel can be entirely filled with liquid throughout preparation of the silver halide dispersion. This offers the distinct advantage of avoiding air (or any other ambient atmosphere) being entrained in the dispersion during its preparation. This in turn permits a much higher rate of stirring of the dispersion by the stirring mechanism 3, if desired, since with an enclosed and filled reaction vessel the risk of forming a vortex and drawing air into the silver halide dispersion (which results in foaming) is obviated.

The silver halide grains produced as a reaction product can include coarse, medium, or fine silver halide grains bounded by 100, 111, or 110 crystal planes and can be prepared by a variety of specific techniques, as illustrated by G. F. Duffin, *Photographic Emulsion Chemistry,* Focal Press, London, 1966, pp. 57–82, and V. L. Zelikman and S. N. Levi, Making and Coating Photographic Emulsions, Focal Press, London, 1964, pp. 69–160 and 219–228.

The silver halide grains produced as a reaction product preferably exhibit a relatively narrow size-frequency distribution. That is, the silver halide dispersions formed are preferably monodispersed. Generally, in such dispersions, no more than 5 percent, by weight, of the silver halide grains smaller than the mean size and no more than about 5 percent, by number, of the silver halide grains larger than the mean grain size, vary in diameter from the mean grain diameter by more than about 40 percent. Frequently the definition of monodispersity is stated more succinctly as requiring at least 95 percent, by weight or by number, of the silver halide grains to vary in diameter from the mean grain diameter by less than 40 percent. Definitions of preferred and optimum monodispersity substitute 25 percent and 10 percent, respectively, for the 40 percent reference point appearing in the above definitions. The diameter referred to is the effective diameter; that is, the diameter of a circle corresponding in area to the area subtended by a silver halide grain as viewed through a microscope or in a photomicrograph. The measurement of silver halide grain sizes is discussed further in Mees and James, *The Theory of the Photographic Process,* 3rd ed., Macmillan, 1966, pp. 36–43. Polydispersed silver halide grains—that is, those having a relatively broad size-frequency distribution-can be produced by additional nucleation occurring during the growth stage and by variations in growth rates from grain to grain, as can result from crystal irregularities in the individual silver halide grains.

Polydispersed radiation-sensitive silver halide grains are commonly favored for photographic applications requiring wide exposure latitude and low contrast while monodispersed radiation-sensitive grains are favored for a variety of photographic applications, including those requiring high contrast, formation of core-shell grains by Ostwald ripening, blending, and uniform fogging or sensitization. Monodispersed radiation-sensitive silver halide grains are particularly advantageous in graphic arts and direct-positive photography. Since monodispersed silver halide grains are more uniform than polydispersed silver halide grains, they can be more optimally and efficiently treated for many photographic applications than polydispersed silver halide grains. Note, for example, Illingsworth U.S. Pat. No. 3,501,305. It is common practice in the art to blend dissimilar monodispersed silver halide dispersions to adjust contrast, latitude, and other photographic properties.

In forming silver halide emulsions peptizer concentrations of from 0.2 to about 10 percent by weight, based on the total weight of emulsion components in the reaction vessel, can be employed; it is preferred to keep the concentration of the peptizer in the reaction vessel prior to and during silver halide formation below about 6 percent by weight, based on the total weight. It is common practice to maintain the concentration of the peptizer in the reaction vessel in the range of from about 2 to 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 300 grams per mole of silver halide. Preferably the concentration of vehicle in the finished emulsion is below 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al. U.S. Pat. Nos. 2,787,545 and 2,956,880, Himmelmann et al. U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al U.S. Pat. No. 3,227,571, Boyer et al. U.S. Pat. No. 3,532,502, Malan U.S. Pat. No. 3,551,151, Lohmer et al U.S. Pat. No. 4,018,609, Luciani et al U.K. Pat. No. 1,186,790, U.K. Pat. No. 1,489,080 and Hori et al Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.s. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

Although not required for the practice of this process, it is preferred that a silver halide grain ripening occur within the reaction vessel during silver halide formation. Known silver halide solvents are useful in promoting ripening. For example, both ammonia and a stoichiometric excess of halide ions, when present in the reaction vessel, are known to promote silver halide ripening. It is therefore apparent that the halide salt solutions run into the reaction vessel can themselves promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among preferred ripening agents are those containing sulfur. Conventional thioether ripening agents, such as those disclosed in McBride U.S. Pat. No. 3,271,157, Jones U.S. Pat. No. 3,574,628, and Rosecrants et al U.S. Pat. No. 34,737,313, here incorporated by reference, can be employed. Sufficient thioether ripening agent is employed to provide concentrations of from 0.05 to 50 grams, preferably about 0.1 to 20 grams, per mole of silver halide, based on the weight of silver.

Certain of the preferred organic thioether silver halide solvents can be represented by the formulas:

$$Q-[(CH_2)_r-CH_2-S-(CH_2)_2-X-(R)_p-(CH_2)_2-(R')_q-S-CH_2(CH_2)_m-Z]_n$$

and $$Q-(CH_2)_m-(CH_2-S-(CH_2)_n-S-CH_2-(CH_2)_r-Z$$

wherein: r and m are integers of 0 to 4; n is an integer of 1 to 4; p and q are integers of 0 to 3; X is an oxygen atom (—O—), a sulfur atom (—S—), a carbamyl radical $$(-\overset{O}{\overset{\|}{C}}NH-),$$

a carbonyl radical $(-\overset{O}{\overset{\|}{C}}-)$ or a carboxy radical $(-\overset{O}{\overset{\|}{C}}OH)$;

R and R′ are ethylene oxide radicals ($—O—CH_2CH_2—$); Q and Z are hydroxy radicals (—OH), carboxy radicals, or alkoxy radicals (—O—alkyl) wherein the alkyl group has 1 to 5 carbon atoms; and Q and Z can also be substituents described for X linked to form a cyclic compound.

Preferred organic thioether silver halide ripening agents suitable for forming the emulsions of the invention include compounds represented by the formulas:

$$HO(—R^2—S—)_rR^2OH,$$

$$(HO—R^2—S—R^2—O—R^4)_2,$$

$$R^3—OR^2—S—R^2—\overset{\overset{\displaystyle O}{\|}}{C}NH—R^4—)_2,$$

$$(R^3—O—R^2—S—R^2—)_2S,$$

$$(R^3—NH\overset{\overset{\displaystyle O}{\|}}{C}—R^2—S—R^2—)_2O, \text{ and}$$

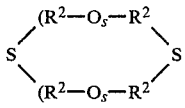

wherein: r is an integer of 1 to 3; s is an integer of 1 to 2; $R^2$ is an alkylene radical having 1 to 5 carbon atoms and is preferably ethylene ($—CH_2CH_2—$); $R^3$ is an alkyl radical having 1 to 5 carbon atoms and is preferably ethyl; and $R^4$ is an alkylene radical having 1 to 5 carbon atoms and is preferably methylene ($—CH_2—$).

As an alternative to thioether ripening agents, thiocyanate salts can be used, such as alkali metal, most commonly potassium, and ammonium thiocyanate salts. While any conventional quantity of the thiocyanate salts can be introduced, preferred concentrations are generally from about 0.1 to 20 grams of thiocyanate salt per mole of silver halide, based on the weight of silver. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference.

Among known techniques capable of separating a portion of the dispersing medium while retaining silver halide grains in the dispersion remaining, ultrafiltration constitutes a particularly advantageous approach for the practice of this process. A variety of ultrafiltration techniques are known. The ultrafiltration unit 15 illustrated can be of any convenient conventional construction. For example, useful ultrafiltration units and their use are illustrated by *Research Disclosure,* Vol. 102, October 1972, Item 10208, Hagemaier et al *Research Disclosure,* Vol. 131, March 1975, Item 13122, Bonnet Research Disclosure, Vol. 135, July 1975, Item 13577, Berg et al German OLS No. 2,436,461 and Bolton U.S. Pat. No. 2,495,918.

Ultrafiltration is preferably accomplished by pumping dispersion from the reaction vessel into contact with a semipermeable membrane of the ultrafiltration unit so that a pressure difference is established across the membrane. The membranes contain pores sized to permit penetration by molecules below a particular size while retaining larger molecules and silver halide grains in the dispersion. Suitable membranes can be selected from among those exhibiting penetration cutoff in the molecular weight range of from about 500 to 300,000 or more, preferably from about 500 to 50,000. Generally the choice of a specific penetration cutoff is a function of the silver halide grain size at the outset of ultrafiltration and the lowest molecular weight material sought to be retained in the dispersion remaining (or retentate) after separation of dispersing medium and/or soluble salts. It is fortunate that the molecular weight of the soluble reaction product of halide and salt solutions (e.g., alkali nitrate) is low, thereby facilitating selection of a penetration cutoff which allows selective retention of the silver halide grains and peptizer, if any, present in the dispersion.

The pressure of the dispersion pumped into the ultrafiltration unit can vary over a wider range. Typically the input pressure is about 100 psig while the outlet pressure of the retentate is up to about 10 psig. The pressure differential across the membrane is typically in the range of from about 40 to 60 psi. It is, of course, within the skill of the art to operate at pressures outside of these ranges, depending upon the construction of the ultrafiltration unit, the viscosity of the dispersion, the concentration of the retentate, and the purity of the retentate desired. The ultrafiltration unit is preferably operated at a temperature within the range of conventional silver halide precipitation temperatures.

The membranes employed in ultrafiltration are typically anisotropic membranes which comprise a very thin layer of extremely fine pore texture supported upon a thicker porous structure. Useful membranes can be formed of a variety of polymeric materials, such as poly(vinyl chloride), poly(vinyl carboxylate)—e.g., poly(vinyl formate) and poly(vinyl acetate), poly(vinyl alcohol), polysulfones, poly(vinyl ether), polyacrylamides and polymethacrylamides, polyimides, polyesters, polyfluoroalkylenes—e.g., polytetrafluoroethylene and polyvinylidene fluoride, and cellulosic polymers, such as, cellulose and cellulose esters—e.g., cellulose acetate, cellulose butyrate and cellulose acetate butyrate.

Although the process has been described by reference to a simple ultrafiltration loop containing a single ultrafiltration unit, it is appreciated that the ultrafiltration loop can be altered without departing from the invention. For example, instead of employing a single ultrafiltration unit, two or more ultrafiltration units can be used in series. Further, two or more independent ultrafiltration loops can be provided. Composite ultrafiltration loops can also be employed. For example, where the ultrafiltration unit 15 has a relatively high cutoff, the withdrawn dispersing medium comprising the flow path 17 can be fed to a second ultrafiltration unit having a substantially lower cutoff. The retentate from the second ultrafiltration unit can then be returned to the reaction vessel.

Although the invention has been specifically described in terms of an external ultrafiltration unit, so that a portion of the dispersion is withdrawn from the reaction vessel, reduced in volume, and returned to the reaction vessel, it is appreciated that ultrafiltration need not occur externally of the reaction vessel. For example, the ultrafiltration unit could be immersed in the dispersion within the reaction vessel with the removed salts and water being conducted out of the reaction vessel through a suitable conduit. In another form a tubular ultrafiltration membrane can be immersed in the reaction vessel with the water and salts entering the interior of the tubular ultrafiltration membrane through its walls being withdrawn through a suitable conduit to the exterior of the reaction vessel. In still another form the ultrafiltration membrane can itself form a portion of the wall of the reaction vessel. Such an arrangement is more specifically disclosed in Brown et al U.S. Ser. No. 272,612, filed June 11, 1981, titled SILVER HALIDE PRECIPITATION PROCESS WITH DELETION OF MATERIALS THROUGH THE REACTION VESSEL, commonly assigned, and here incorporated by reference. From the foregoing it is apparent that the present invention embraces generally removing dispersing medium from the reaction vessel during silver halide grain growth without removing the silver halide grains. The various structural relationships described above are merely illustrative of specific embodiments intended to achieve this desired result.

The proportion of dispersing medium removed by the ultrafiltration unit can be controlled to any desired level by routine adjustment of flow rates and pressure differentials. The volume of the silver halide dispersion at the completion of concurrent silver and halide salt additions as a percentage of the total volume of materials introduced can be varied widely, depending upon the silver halide dispersion characteristics desired. In those instances in which silver halide dispersions are being formed in the absence of a peptizer and with dilute halide salt washing the proportion of dispersing medium removed can be quite high. Typically the proportion of dispersing medium (including dissolved salts) removed is from about 10 to 90 percent of the total volume of materials introduced. It is generally preferred that the proportion of dispersing medium removed be at least 50 percent of the total materials introduced.

In the course of preparing silver halide dispersions according to this process, particularly in the absence of a peptizer, a very high proportion of the dispersing medium can be introduced through the third jet. In one preferred form the third jet introduces the dilute aqueous halide salt solution described above at a flow rate of from 10 to 30 times the combined flow rates of the silver and halide salt solutions of the first and second jets. In such instances the third jet and the ultrafiltration unit are working together to reduce markedly the soluble salt concentration of the silver halide dispersion. The large excess of dispersing medium introduced by the third jet can be easily removed by ultrafiltration and can be distinctly advantageous in providing optimum flow levels within the ultrafiltration unit chosen for use.

It is specifically contemplated to continue introduction through the third jet and ultrafiltration after flow through the first and second jets has been terminated. It is further contemplated to alternate periods in which the first and second jets and/or the third jet are open with periods in which only the third jet is open. Thus, the third jet and ultrafiltration unit can together reduce soluble salt concentrations during silver halide formation, during interruptions in silver halide formation and/or after silver halide formation.

As the size of the silver halide grains increases in the absence of a peptizer, the risk of flocculation increases, and lowering the soluble salt concentration becomes increasingly important. The flow rate through the third jet can be progressively increased as the run progresses. It is also possible to interrupt silver and halide salt solution introductions through the first and second jets at more frequent intervals as the run progresses.

The addition of silver and halide salt solutions is terminated after they have been introduced in an amount sufficient to produce silver halide grains of the desired size. One of the salts can be added thereafter to adjust the pAg of the silver halide dispersion, if desired, although this is not necessary. Ultrafiltration can be terminated along with concurrent silver and halide salt additions, or it can be continued to remove additional soluble salts and dispersing medium, even when a third jet is not employed or it is closed. When all additions and ultrafiltration are terminated, the silver halide dispersion is removed from the reaction vessel for subsequent processing in any conventional manner. For example, the silver halide dispersion can be removed from the reaction vessel and washed by conventional techniques, as illustrated by *Research Disclosure,* Item 17643, cited above, Paragraph II Emulsion Washing.

In the simplest form of the invention the nucleation and growth stages of silver halide precipitation occur in the same reaction vessel during the course of a single batch double-jet precipitation run. It is, however, recognized that silver halide precipitation can be interrupted, particularly after completion of the growth stage. Further, two separate reaction vessels can be substituted for the single reaction vessel described above. The nucleation stage of silver halide preparation can be performed in an upstream reaction vessel (herein also termed a nucleation vessel) and the dispersed silver halide grain nuclei can be transferred to a downstream reaction vessel in which the growth stage of silver halide precipitation occurs (herein also termed a growth reaction vessel). In one arrangement of this type an enclosed nucleation vessel can be employed to receive and mix reactants upstream of the growth reaction vessel, as illustrated by Posse et al, Forster et al, Finnicum et al, and Verhille et al, cited above. In these arrangements the contents of the growth reaction vessel are recirculated to the nucleation reaction vessel.

It is herein contemplated that various parameters important to the control of silver halide grain formation and growth, such as pH, pAg, ripening, temperature, and residence time, can be independently controlled in the separate nucleation and growth reaction vessels. To allow silver halide nucleation to be entirely independent of silver halide grain growth occurring in the growth reaction vessel downstream of the nucleation vessel, no portion of the silver halide dispersion present in the growth reaction vessel should be recirculated to the nucleation vessel. Since the nucleation stage of silver halide precipitation can thus be independent of the growth stage, it is apparent that the nucleation stage of silver halide precipitation can be performed by conventional silver halide precipitation processes in addition to batch double-jet processes, such as single jet and continuous double-jet precipitation processes, such as those illustrated by James, Trivelli and Smith, Claes, and Terwilliger et al, cited above.

Silver salt solution can be independently run into the nucleation vessel only or into both the nucleation and growth reaction vessels. Halide salt solutions can be initially present in and/or run into the nucleation vessel. Since soluble halide salts are removed by ultrafiltration and since it is usually desirable for silver halide grain growth to occur in the presence of a stoichiometric excess of halide ions, in most instances soluble halide salts will be added to the growth reaction vessel, either from the nucleation vessel or independently. Third jets, described above for use either for delivering peptizer or diluting the soluble salts, can be directed into the nucleating vessel, the growth reaction vessel, or both. When the third jet is employed for diluting the soluble salts formed by reaction, it is preferred that the third jet be directed into the growth reaction vessel. Where nucleation and growth reaction vessels are employed in combination, it is preferred that the ultrafiltration loop be related to the growth reaction vessel as shown in FIG. 1, so that dispersion is both received from and returned to the growth reaction vessel by the ultrafiltration loop. Where recirculation from the growth reaction vessel to the nucleation vessel is contemplated, the ultrafiltration loop can be employed to return dispersion to the nucleation vessel initially received from the growth reaction vessel. Other variant arrangements are, of course, possible.

It is specifically contemplated to blend the silver halide dispersion with other silver halide dispersions prepared by the process of this invention or other conventional procedures, although this is not required. Blending can occur immediately following the silver halide precipitation run or at any subsequent stage prior to coating.

The silver halide dispersions can be further prepared for use by conventional procedures of the type disclosed in *Research Disclosure,* Item 17643, cited above. They can be chemically sensitized as described in Paragraph III Chemical sensitization. They can be spectrally sensitized or desensitized as described by Paragraph IV Spectral sensitization and desensitization. Other conventional photographic addenda can be added to the silver halide dispersions, such as described by Paragraph V Brighteners and Paragraph VI Antifoggants and stabilizers. The addenda can be added to the silver halide dispersions by conventional techniques, such as described by Paragraph XIV Methods of addition. It is also contemplated to place the addenda, particularly the spectral sensitizing dyes, in the reaction vessel prior to silver halide precipitation or to run these materials into the reaction vessel during silver halide precipitation, preferably during the growth stage. Teachings of such techniques are contained in Hill U.S. Pat. No. 3,628,960, Locker et al U.S. Ser. No. 881,230, filed Feb. 27, 1978, and Locker U.S. Ser. No. 944,666, filed Sept. 22, 1978. It is specifically recognized that the addition of vehicle can be delayed until after addenda have been added to the silver halide dispersions, since the addenda can be more effective when added in the absence of a vehicle. Hardeners, as disclosed in Paragraph X Hardeners, are employed in combination with the vehicles.

The silver halide dispersions can be employed to form silver halide photographic elements of any desired conventional form. Exemplary conventional photographic elements and features thereof are disclosed in *Research Disclosure,* Item 17643, cited above, Paragraphs VII Cclor materials, VIII Absorbing and scattering materials, XI Coating aids, XII Plasticizers and lubricants, XVI Matting agents, XVII Supports, XX Developing agents, XXI Development modifiers, XXII Physical development systems, XXIII Image transfer systems, XXIV Dry development systems, XXV Printing and lithography, XXVI Printout and XXVII Directprint. The silver halide dispersions and other layers of the photographic elements can be coated by the procedures set out in Paragraph XV Coating and drying procedures. The photographic elements can be exposed and processed by conventional procedures, such as those of Paragraphs XVIII Exposure and XIX Processing.

The following examples illustrate the invention.

EXAMPLE 1

Demonstrating Colloid-Free Silver Halide Precipitation

Step 1—Nucleation

An arrangement was employed as shown in the drawing. The reaction vessel 1 initially contained 48 liters of a 0.005 molar potassium bromide solution to form a body 3 of dispersing medium. A silver salt solution and a halide salt solution were then simultaneously introduced through first jet 7 and second jet 9. The silver salt solution was a 1.00 molar silver nitrate aqueous solution, and the potassium salt solution was a 1.01 molar potassium bromide aqueous solution. The jet flow rates were constant and equal at 40 ml per minute. A 30 minute run time was allowed to complete the nucleation stage of silver halide preparation. During the nucleation stage the contents of the reaction vessel were maintained at 40° C., the pH at 5.5 and the pAg at 9.28.

Step 2—Washing of Silver Halide Nuclei

Silver halide dispersion was taken from the reaction vessel at the rate of 1500 ml per minute (indicated in the drawing as flow path 13) and fed to an ultrafiltration unit 15. The ultrafiltration unit was fitted with a poly(vinyl acetate) semipermeable membrane, type IRIS 3022, commercially available from Societe Rhone-Poulenc, having a working surface of 1 square meter and a filtering capacity of from 10,000 to 20,000 liters per square meter per 24 hours. The potassium nitrate aqueous solution formed was a by-product during the precipitation of the silver bromide that passed through the semipermeable membrane, was withdrawn, indicated by flow path 17, at a rate of 1 liter per minute while the filtered silver halide dispersion, indicated by flow path 19, was returned to the reaction vessel at the rate of 500 ml per minute. This step was conducted for a period of 28 minutes. A total of 28 liters of dissolved salts was removed while 25 liters of the washing solution was introduced through the third jet, thereby the volume of the reaction medium was kept substantially constant. This washing operation was repeated again.

Step 3—Growth of the Silver Halide Crystals

The first and second jets 7 and 9 were started again while the third jet 11 and the ultrafiltration loop remained in operation. This was continued for 15 minutes.

Step 4—Washing of the Silver Halide Crystals

Step 2 was repeated, but for 15 minutes.

Step 5—Growth of the Silver Halide Crystals

Step 3 was repeated.

Subsequent Preparation and Examination

At the conclusion of the final washing step phthalated gelatin was added, and coagulation washing was undertaken followed by redispersion according to conventional techniques. This was twice repeated. Water and an aqueous gelatin solution were then added to adjust the emulsion concentration so that a volume of 3.8 liters of emulsion contained 1 mole silver bromide and 5 percent by weight gelatin. The resulting emulsion was gold and sulfur sensitized. Microscopic examination revealed a monodispersed emulsion containing silver halide grains of a mean diameter of 0.3 micron. The emulsion was coated onto a poly(ethylene terephthalate) support and sensitometrically examined. The properties of the emulsion were similar to those of a control emulsion prepared by silver halide precipitation in the presence of gelatin. This demonstrated usefulness of the process in preparing radiation-sensitive silver halide dispersions.

EXAMPLE 2

Demonstrating Peptized Silver Halide Preparation

A cubic, monodispersed 0.25 micron silver bromoiodide (2.5 mole percent iodide) emulsion was prepared as follows:

Step 1—Nucleation

An arrangement similar to that of Example 1 was employed. The reaction vessel 1 initially contained Solution A, identified below. Solutions B and C, identified below, were added simultaneously with vigorous stirring to Solution A over a period of 36 minutes while maintaining the pAg of Solution A at 8.7.

| | |
|---|---|
| Solution A | |
| Gelatin | 2.16 kg |
| Distilled water | 67.5 kg |
| 1,8-dihydroxy-3,6-dithiaoctane | 8.0 g |
| Temperature 71.1° C., pAg 8.9 | |
| Soltuion B | |
| $AgNO_3$ | 31.104 kg |
| Distilled water | 30.6 kg |
| Temperature 58.9° C. | |
| Solution C | |
| KBr | 21.205 kg |
| KI | 0.778 kg |
| Distilled water | 30.6 kg |
| Temperature 70° C. | |

Step 2—Growth

Five minutes after beginning the precipitation, the reaction vessel's contents were cycled through two spiral wound (2 inch diameter×3 feet) polysulfone (1,000 average molecular weight) ultrafiltration membrane units at 1.8 kg emulsion per minute to remove water from the emulsion at the same rate that it was being introduced to the reaction vessel via Solutions B and C, thereby maintaining a constant reactor volume (608 liters) throughout the remainder of the precipitation step. After the addition of Solutions B and C was completed (36 minutes), the emulsion was cooled to 37.8° C. and then cycled through three (2 inch diameter×3 feet) polysulfone (20,000 average molecular weight) semi-permeable membrane units until the pAg of the emulsion was 8.2. Additional gelatin (12.24 kg) was added, the emulsion was heated to 43.3° C. and stirred until the gelatin had dissolved, and then additional water was added to bring the total weight to 72.0 kg. The emulsion was then cooled and stored.

The invention has been described with particular reference to preferred embodiments thereof but it will be understood that variations and modifications can be effected within the spirit and scope of the invention.

What is claimed is:

1. In a process comprising forming a radiation-sensitive silver halide dispersion by reacting silver and halide salts in solution, wherein the silver and halide salts are reacted to form silver halide grain nuclei in the presence of a dispersing medium and silver halide grain growth is allowed to proceed in a reaction vessel in which the silver halide grain nuclei and the dispersing medium are present, the improvement comprising, while increasing the silver halide present in the dispersing medium during silver halide grain growth, reducing the volume of the dispersion by separating a portion of the dispersing medium while retaining the silver halide grains within the dispersion remaining.

2. In a double-jet batch process comprising forming a radiation-sensitive silver halide dispersion by reacting a silver salt solution and a halide salt solution within a dispersing medium to achieve silver halide grain nucleation followed by silver halide grain growth, wherein during silver halide grain growth the silver and halide salts are concurrently run into a reaction vessel containing the dispersing medium, the improvement comprising, while running the silver and halide salt solutions and during silver halide grain growth, withdrawing a portion of the dispersion from the reaction vessel, reducing the volume of the withdrawn dispersion by separating a portion of the dispersing medium while retaining the silver halide grains within the remaining withdrawn dispersion, and returning the remaining withdrawn dispersion to the reaction vessel.

3. An improved process according to claim 1 or 2 in which the dispersing medium contains a peptizer.

4. An improved process according to claim 3 in which the dispersing medium contains a hydrophilic colloid peptizer.

5. An improved process according to claim 1 or 2 in which the dispersing medium is substantially free of a hydrophilic colloid peptizer and the concentration of soluble salts present in the dispersion is maintained below 0.1 mole per liter.

6. An improved process according to claim 1 or 2 in which the silver halide grains formed in the silver halide dispersion are substantially monodispersed.

7. An improved process according to claim 1 or 2 in which the volume of the dispersion is reduced using an ultrafiltration unit containing a semipermeable membrane.

8. An improved process according to claim 1 or 2 in which a silver halide ripening agent is present in the reaction vessel during introduction of the silver and halide salt solutions.

9. An improved process according to claim 1 or 2 in which additional dispersing medium is separately run into the reaction vessel concurrently with the silver and halide salt solutions.

10. An improved process according to claim 1 or 2 in which the volume of the silver halide dispersion in the reaction vessel is maintained substantially invariant while at least a portion of the silver and halide salts are being introduced.

11. In a double-jet batch process of preparing a silver halide dispersion in the absence of a hydrophilic colloid peptizer comprising forming a dispersion of radiation-sensitive silver halide grains and a soluble salt reaction product by reacting water soluble silver and halide salts within a dispersing medium to achieve silver halide grain nucleation followed by silver halide grain growth, wherein during silver halide grain growth the silver and halide salts are separately introduced as aqueous solutions through first and second jets into a reaction vessel containing the dispersing medium, the improvement of protecting the silver halide grains from flocculation comprising, while running the first and second jets and during silver halide grain growth, separately introducing into the reaction vessel through a third jet a less than 0.01 molar aqueous halide salt solution, withdrawing a portion of the dispersion from the reaction vessel, passing the withdrawn portion of the dispersion through an ultrafiltration unit containing a semipermeable membrane, thereby separating a portion of the dispersing medium and soluble salt reaction product from the silver halide grains within the dispersion remaining, and returning the remaining withdrawn dispersion to the reaction vessel.

12. An improved process according to claim 11 in which withdrawal of soluble salt reaction product maintains its concentration in the reaction vessel at less than 0.1 mole per liter.

13. An improved process according to claim 12 in which withdrawal of soluble salt reaction product maintains its concentration in the reaction vessel at less than 0.01 mole per liter.

14. An improved process according to claim 11 in which the flow rate to the third jet is from 10 to 30 times the combined flow rates to the first and second jets.

15. An improved process according to claim 11 in which delivery from the first and second jets is interrupted while the third jet continues to deliver the aqueous halide salt solution to the reaction vessel.

16. In a process comprising forming a radiation-sensitive silver halide dispersion by reacting silver and halide salts in solution, wherein the silver and halide salts are reacted to form silver halide grain nuclei in the presence of a dispersing medium and silver halide grain growth is allowed to proceed in a reaction vessel in which the silver halide grain nuclei and the dispersing medium are present, the improvement comprising during silver halide grain growth separating a portion of the dispersing medium while retaining the silver halide grains within the dispersion remaining.

17. In a double-jet batch process of preparing a photographic silver halide emulsion comprising forming a silver halide emulsion by reacting aqueous silver and halide salts within a dispersing medium to achieve silver halide nucleation followed by silver halide grain growth, wherein at least during silver halide grain growth the dispersing medium is present in a reaction vessel, a hydrophilic colloid peptizer is present in the dispersing medium, and the silver and halide salt solutions are concurrently run into the reaction vessel containing the dispersing medium, the improvement comprising withdrawing a portion of the silver halide emulsion from the reaction vessel during silver halide grain growth, passing the withdrawn portion of the silver halide emulsion through an ultrafiltration unit containing a semipermeable membrane to separate a portion of the dispersing medium from the silver halide grains and hydrophilic colloid and thereby reduce the volume of the silver halide emulsion withdrawn, and returning the withdrawn emulsion, reduced in volume, to the reaction vessel.

18. An improved process according to claim 11, 16, or 17 in which the silver halide withdrawn from the reaction vessel is absent for less than 10 percent of the total run time.

19. An improved process according to claim 11, 16, or 17 in which the silver halide withdrawn from the reaction vessel is less than 50 percent of the total silver halide present in the reaction vessel.

20. An improved process according to claim 19 in which the silver halide withdrawn is less than 25 percent of the total silver halide present in the reaction vessel.

21. An improved process according to claim 11, 16, or 17 in which the total dispersing medium separated comprises from 10 to 90 percent of the total volume of materials introduced into the reaction vessel.

22. An improved process according to claim 21 in which the total dispersing medium separated comprises from 50 to 90 percent of the total volume of materials introduced into the reaction vessel.

23. An improved process according to claim 16 or 18 in which additional dispersing medium is run into the reaction vessel after introduction of silver and halide salt solutions has been completed.

24. An improved process according to claim 11, 16, or 17 in which a thioether or thiocyanate ripening agent is present in the reaction vessel during addition of the silver and halide salt solutions.

25. An improved process according to claim 11, 16, or 17 in which the semipermeable membrane is chosen from among polysulfone, cellulose acetate, and poly(vinyl acetate) membranes.

26. An improved process according to claim 11, 16, or 17 in which the semipermeable membrane has a molecular weight cutoff of from 500 to 50,000.

27. An improved process according to claim 12, 16, or 17 in which the silver halide formed is monodispersed.

* * * * *